United States Patent [19]

Blazley

[11] Patent Number: 4,759,159

[45] Date of Patent: Jul. 26, 1988

[54] BUILDING PANEL JOINT

[75] Inventor: Wade H. Blazley, Eumundi, Australia

[73] Assignee: Blazley Designs Pty. Ltd., Miami, Australia

[21] Appl. No.: 83,909

[22] PCT Filed: Jun. 28, 1985

[86] PCT No.: PCT/AU85/00144

§ 371 Date: Feb. 28, 1986

§ 102(e) Date: Feb. 28, 1986

[87] PCT Pub. No.: WO86/00363

PCT Pub. Date: Jan. 16, 1986

Related U.S. Application Data

[63] Continuation of Ser. No. 845,139, Feb. 28, 1986, abandoned.

[30] Foreign Application Priority Data

Jun. 28, 1984 [AU] Australia ..... PH1126
Mar. 4, 1985 [AU] Australia ..... PG9556

[51] Int. Cl.[4] ..... E04B 1/32
[52] U.S. Cl. ..... 52/86; 52/588
[58] Field of Search ..... 52/588, 86, 536, 542

[56] References Cited

U.S. PATENT DOCUMENTS

| | | | |
|---|---|---|---|
| 2,098,717 | 11/1937 | Calkins | 52/588 |
| 3,276,171 | 10/1966 | Brown | 52/86 |
| 3,606,718 | 9/1971 | Curran | 52/542 |
| 3,902,288 | 9/1975 | Knudson | 52/86 |
| 4,109,437 | 8/1978 | Player | 52/588 |
| 4,192,117 | 3/1980 | Heirich | 52/542 |
| 4,223,503 | 9/1980 | Hagne | 52/588 |
| 4,463,533 | 8/1984 | Mallet | 52/542 |

FOREIGN PATENT DOCUMENTS

| | | | |
|---|---|---|---|
| 2205479 | 8/1973 | Fed. Rep. of Germany | 52/542 |
| 1498797 | 1/1978 | United Kingdom | 52/536 |
| 1054512 | 11/1983 | U.S.S.R. | 52/536 |

*Primary Examiner*—Henry E. Raduazo
*Attorney, Agent, or Firm*—Natter & Natter

[57] ABSTRACT

A building panel or arcuate longitudinal form having a pair of upstanding flanges at its opposite longitudinal sides, a male rib supported by one flange and a female rib supported by the other flange, both the male and female rib extending wholly to one side of their supporting flanges, the male rib being engageable with the female rib of an adjacent panel to form an arcuate self supporting roof section for a building.

10 Claims, 3 Drawing Sheets

BUILDING PANEL JOINT

This application is a continuation of Ser. No. 845,139 filed Feb. 28, 1986 and now abandoned.

TECHNICAL FIELD

This invention relates to improvements to building panels and particularly to building panels for use in the construction of self supporting building structures.

BACKGROUND ART

A number of different types of self-supporting building structures are presently available. One such type of building structure described in Australian Pat. No. 447,874, comprises a plurality of arcuate panels which are interconnected in such a manner as to define a self supporting building structure without the need for trusses, columns or other supports. In this arrangement a plurality of building panels of channel shaped cross section are interconnected by crimping together the respective adjacent longitudinal flanges to form a permanent connection means. Whilst this arrangement is suitable for providing a self supporting structure, expensive equipment is required to form the necessary joints between the panels, and furthermore, the joints formed comprise permanent joints. Other proposals have required the use of separate fastening means to interconnect respective panels. This necessitates in many instances, the formation of holes in the building panels to accommodate the fasteners which not only is time consuming but can lead to water leakage in an erected building.

DISCLOSURE OF INVENTION

The present invention aims to overcome or alleviate at least some of the above disadvantages by providing an improved building panel which may be connected to adjacent similar building panels rapidly and effectively to form a self supporting building structure. The present invention also relates to the method of interconnecting such building panels and to the building structure formed with panels of the above type.

With the foregoing and other objects in view, this invention resides broadly in a building panel including a main body portion and a pair of upstanding side portions extending along respective opposite longitudinal sides of said main body portion, one said side portion including a female rib and the other said side portion including a male rib adapted for interlocking engagement with a said female rib of an adjacent said panel whereby adjacent said panels may be interlocked in use, characterised in that each said side portion includes a flange portion generally upstanding from said main body portion and supporting a respective said male or female rib, said male and female ribs extending wholly to corresponding sides of their respective supporting flange portions such that adjacent said panels may be overlapped at their adjacent side portions and moved relatively towards each other in a direction generally parallel to said side portions to cause said male and female ribs to engage and interlock said panels, the respective adjacent flange portions of said panels when said panels are interlocked being disposed in a substantially juxtaposed attitude.

Preferably the building panel is generally arcuate in a longitudinal direction with the side portions arranged on the convex side thereof. Preferably also the main body portion of the panel has an arcuate cross section.

BRIEF DESCRIPTION OF DRAWINGS

In order that the invention may be more readily understood and put into practical effect, reference will now be made to the accompanying drawings which illustrate a preferred embodiment of the invention and wherein.

MODES FOR CARRYING OUT THE INVENTION

Figure 1:
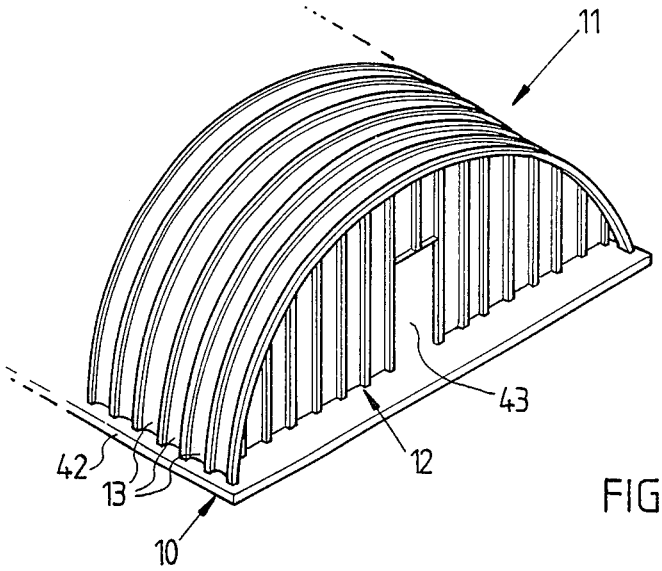
FIG. 1 illustrates a self supporting building constructed in accordance with the present invention.
Figure 2:
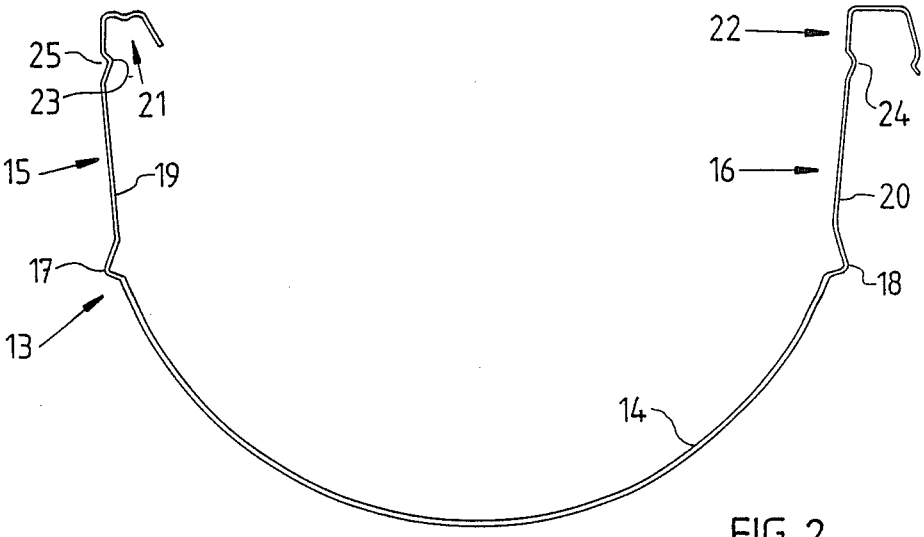
FIG. 2 illustrates in sectional view a building panel for forming the arcuate roof section of the building illustrated in FIG. 1.
Figure 3:
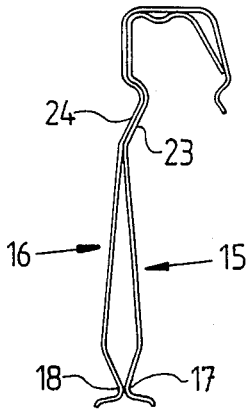
FIG. 3 illustrates the connection between adjacent building panels of the type illustrated in FIG. 2.

Referring to the drawings and firstly to FIG. 1, there is illustrated a building 10 constructed in accordance with the present invention comprising a self supporting arcuate roof section 11 and a pair of upstanding end walls 12 only one of which is illustrated. As shown, the arcuate roof section 11 comprises a plurality of interlocked roof panels 13 each of which is preferably of the profile illustrated in FIG. 2 and which includes a main body portion 14 and respective upstanding side portions 15 and 16. So that the roof panels 13 adopt the substantially longitudinal arcuate attitude shown in FIG. 1, the main body portion 14 is formed to have an arcuate cross section as shown in FIG. 2 whilst the side portions 15 and 16 at their lower ends are deformed outwardly as at 17 and 18 respectively to compensate for the longitudinal curvature of the body portion 14. Each upstanding side portion 15 and 16 includes a main flange portion 19 and 20 respecitvely, each adapted to be disposed and maintained in use in a juxtaposed attitude with the flange portions 19 or 20 of an adjacent panel 13 (see FIG. 3) so as to provide the assembled roof panels 13 with the required structural rigidity. The respective flange portions 19 and 20 are surmounted by respective male and female locking ribs 21 and 22 which extend to common sides of the respective flange portions 19 and 20 and which in use are adapted to be engaged with one another to maintain respective panels 13 in operative engagement.

The upper ends of the flange portions 19 and 20 are also provided with respective complimentary shaped locating projections 23 and 24, the projection 23 defining a concave recess 25 of complimentary shape and size to the projection 24 so that when assembled the projection 24 on the flange portion 20 locates neatly in the concave recess 25 in the flange portion 19 so that the flange portions 19 and 20 may be located in position and in a juxtaposed attitude. This engagement also serves to prevent easy detachment of adjacent roof panels 13. As shown more clearly in FIG. 4, the male rib 21 is of generally inverted U-shaped form with one side flange 26 thereof extending in a generally vertical direction and with the free side flange 26' thereof inclined outwardly from the vertical, in this instance at an angle of approximately 30° thereto. The inclination of the flange 26' is achieved by means of an inward deformation 27 formed in the base of the U-shaped male rib 21. This provides for greater flexibility in the flange 26' to permit the flange 26' to be resiliently deflected inwardly to reduce the lateral dimensions of the rib 21 to facilitate its engagement with the female rib 22.

The female rib 22 is also of generally inverted U-shaped form and again one side flange 28 thereof extends generally vertically whilst the free side flange 28' thereof is slightly inclined to the vertical in this instance at an angle of approximately 15°. The flange 28' is provided adjacent its free end with an inwardly directed deformation 29 substantially aligned with the projection 24 and defining with the latter a restricted entrance into the interior of the female rib 22.

In use and when it is desired to interconnect respective panels 13, the panels 13 are positioned so that their respective longitudinal edges are adjacent to one another with the male and female ribs 21 and 22 respectively overlapping. A force is applied between the adjacent panels 13 in a direction generally parallel to the side portions 15 and 16 so that the adjacent panels 13 move relatively towards each other and so that the male rib 21 is forced through the restricted entrance of the female rib 22 and into the interior thereof. This is accomplished because the flange 26' of the male rib 21 will be resiliently deformed inwardly by virtue of the engagement of the opposite sides of the male rib 21 with the projections 24 and 29 to reduce the lateral dimensions of the rib 21 and at the same time engagement of the male rib 21 with the projections 24 and 29 of the female rib 22 will cause the flange 28' to be resiliently deflected outwardly thus increasing the lateral dimensions of the rib 22 and the width of the restricted entrance thereof to permit the male rib 21 to pass into the interior of female rib 22.

When the end of the flange 26 moves beyond the projection 29, it will resiliently deflect outwardly to "snap-lock" the male rib 21 and female rib 22 together. At the same time, the projection 24 will locate in the recess 25 so that the flange portions 15 and 16 will be located in a juxtaposed relationship with the deformations 17 and 18 in abutment (see FIG. 3) and maintained in that relationship by virtue of the longitudinal arcuate configuration of the panels 13 and the interlocked male and female ribs 21 and 22. It will be seen from FIG. 4 that the flange 26' of the male rib 21 in its operative engaged attitude is in resilient abutment with the flange 28' of the female rib 22 thus maintaining the projection 24 in co-operative engagement with the recess 25 to lock the side portions 15 and 16 together. Furthermore, the flanges 26 and 28 are in face to face abutment and as the flange 26' is located behind the projection 29, detachment of the male and female rib will be resisted.

Figure 5:
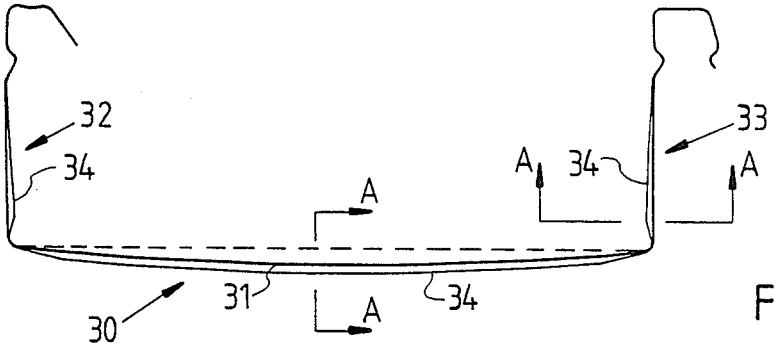
FIG. 5 is a sectional view of an alternative form of building panel for forming the arcuate roof section of the building of FIG. 1.
Figure 6:
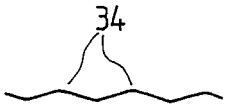
FIG. 6 is a typical cross-sectional view of the panel along line A—A of FIG. 5.

FIG. 5 illustrates an alternative arcuate roof panel 30 for the roof section 11 of the building structure shown in FIG. 1. In this instance, the main body portion 31 of the roof panel 30 and the upstanding side portions thereof 32 and 33 are transversely corrugated as at 34 in the manner shown in FIG. 6. The corrugations 34 form the main body portion 31 into a generally concave external configuration and the corrugations 34 also serve to increase the stiffness of the panels 30.

For the end walls 12 of the building, a plurality of substantially planar panels are provided, each of which are of a similar configuration to the arcuate panel 30 shown in FIG. 5 except that in this instance the main body portion of the panel is uncorrugated (as shown in dotted outline) and of substantially planar form as are the upstanding side flange portions so as to be in face to face abutment when engaged with adjacent planar flange portions.

Figure 7:
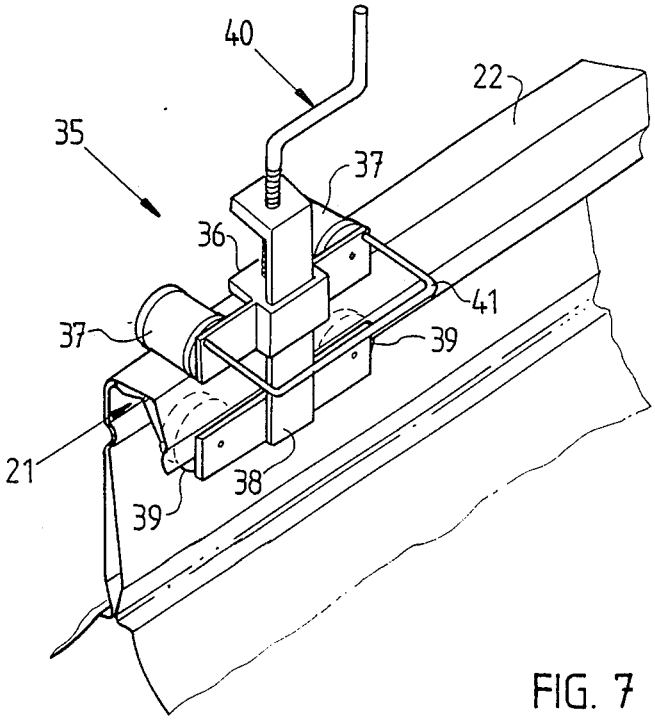
FIG. 7 illustrates in perspective view, a preferred method and tool for interconnecting building panels formed in accordance with the present invention.

In the construction of a self supporting building of the type illustrated in FIG. 1, planar panels of the above described type are initially formed preferably on site with mobile roll forming apparatus. To form the arcuate roof panels 13 for the roof section 11, the previously rolled panels are fed, on site, into deforming or corrugating apparatus to form the body portions thereof into the arcuate or trough shape shown in FIG. 2 or corrugations into the panel in the manner shown in FIGS. 5 and 6. The so formed roof panels 13 or 30 are then interconnected preferably with a connection tool 35 and in the manner shown in FIG. 7. The tool 35 includes a first frame portion 36 supporting a pair of rollers 37 adapted for engagement with the upper surface of the female rib 22 and a second frame portion 38 which supports a further pair of rollers 39 which locate in use within the interior of the male rib 21. The frame portions 36 and 38 are slidably interconnected to permit the rollers 37 and 39 to move towards or away from each other whilst actuating means 40 in the form of a threaded cranked member is threadedly engaged with the frame portion 38 and abutted against the frame portion 36 so that the frame portions 36 and 38 and associated rollers can be moved towards each other. Preferably the frame portion 36 includes a U-shaped handle portion 41 to permit the tool 35 to be grasped and moved along the panel ribs.

Figure 4:
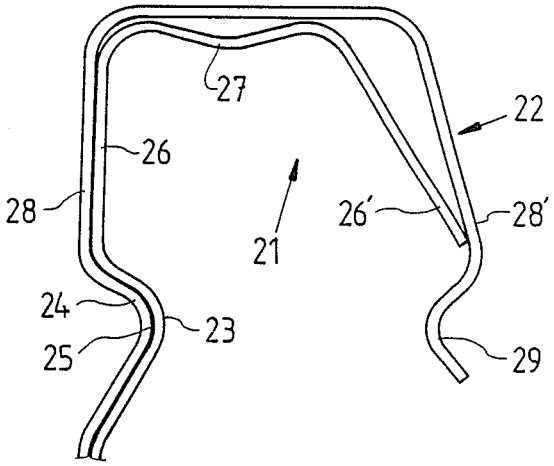
FIG. 4 is an enlarged view illustrating the "snap-lock" connection between adjacent building panels.

In use a first panel 13 (or 30) is laid on the ground and a second panel 13 laid on the first panel 13 with the respective male and female ribs in alignment. The tool 35 is located at one end of the panels 13 and disposed relative to the ribs in the manner shown in FIG. 7. The cranked member 40 is then rotated to move the frame portions 36 and 38 and rollers 37 and 39 towards each other to force the male rib 21 into operative engagement with the female rib as shown in FIG. 4. The tool handle 41 is then grasped and the tool moved along the ribs to force the male rib 21 into the female rib 22 along the full length of the panels. This procedure may be repeated for each respective panel 13, however, preferably sets of three panels are interconnected on the ground as described above and then erected. The respective erected sets of panels 13 are then interconnected again by the use of the tool 35 and in this instance a cord or rope is attached to the handle 41 and passed to the other side of the building where it is grasped so that the tool 35 may be drawn along the panel ribs and over the roof to interconnect the panel sets.

The opposite ends of the erected panels may then be set into a concrete foundation 42 (see FIG. 1) or alternatively fixed by an alternative anchoring arrangement.

The end walls 12 may then be formed by interconnecting a plurality of planar panels. The lower ends of the interlocking planar panels may also be set into a concrete foundation 42, whilst at their upper ends the upstanding side portions of the planar panels are preferably cut away so that the projecting generally planar body portions may extend between the interlocked side portions 15 and 16 of adjacent arcuate panels so that the end walls are supported at their upper ends. Of course, door or wall cut-outs 43 may be formed in the end walls 12 where desired. Many other arrangements may be provided for supporting the upper ends of the walls such as by means of a channel section fixed to the underside of the arcuate roof panels 13 which locates the upper ends of the planar panels.

The male and female rib configurations of the embodiment described above permit the panels to be interconnected by forces applied to the respective male and/or female ribs from one side of the panels only as by the tool 35. Alternatively, respective panels may be simply supported on one side and adjacent panels engaged therewith by applying a force say by body weight, to the overlapping panel to force the female rib over the male rib.

The present invention therefore provides an arrangement whereby panels may be simply interconnected to form a self supporting structure without the need for permanent interconnections such as fasteners or seams. In the configurations illustrated, the projections 23 and 24 may be eliminated if desired. Furthermore, many different configurations of male and female ribs may be employed for interconnecting the panels in lieu of the arrangement illustrated and described above. The above arrangements may also be applied to many different building structures other than that shown in FIG. 1.

Whilst the above has been given by way of illustrative example of the invention, it will be realised that many modifications and variations as would be apparent to persons skilled in the art may be made to the above described embodiment without departing from the broad scope and ambit of the invention as is defined in the appended claims.

I claim:

1. A building panel having in transverse cross-section a main body portion and a pair of side engagement portions at the respective opposite sides of said main body portion, each said side portion including support flange means extending upwardly from said main body portion, the flange means of one said side portion terminating in a female rib and the flange means of the other said side portion terminating in a male rib adapted for interlocking engagement with a said female rib of a further said panel whereby adjacent said panels may be interlocked in use, said female rib extending wholly to one side of its supporting flange means and away from said main body portion and said male rib extending from its supporting flange means in the same direction as said female rib whereby to permit adjacent said panels to be overlapped at the adjacent said side portions and be moved in the general direction of said side portions to enable said male rib of one said panel to engage and interlock with said female rib of the adjacent said panel, said female rib being of generally inverted U-shape form in transverse cross-section and having a first leg comprising an extension of said supporting flange means of said female rib and a second leg spaced from said first leg, said second leg having at its free end, an inwardly directed first deformation, and there being provided a second deformation in the region of the junction between said first leg and said supporting flange means arranged substantially opposite and extending inwardly towards said first deformation to define with said first deformation a restricted entrance into the interior of said female rib, said male rib being of generally inverted U-shape form in transverse cross-section and including a first leg comprising an extension of said supporting flange means of said male rib, and a second leg spaced from said first leg and inclined outwardly away from said first leg, and there being provided an inwardly directed projection defining a recess in the region of the junction between said first leg and said supporting flange means of said male rib, said recess being complementary to said second deformation, the arrangement being such that when interlocked said male rib is located within said female rib, said first legs of said male and female ribs are juxtaposed, said second leg of said male rib resiliently engages said second leg of said female rib rearwardly of said first deformation and said second deformation nests within said recess.

2. A building panel according to claim 1 wherein said main body portion is generally arcuate in cross section concave from the upper side of said panel and wherein said panel is arcuate longitudinally with said side portions disposed on the convex side thereof.

3. A building panel according to claim 2 wherein said main body portion and said flange means are transversely corrugated.

4. A building panel according to claim 2, wherein said flange means adjacent their lower ends are deformed outwardly, said outward deformations of the flange means of adjacent said panels being in substantial abutment when adjacent said panels are interlocked.

5. A building structure including a plurality of interlocked building panels of the type according to claims 2, 3 or 4, said interlocked panels defining a self supporting arcuate roof section for said building structure.

6. A building panel having a generally arcuate configuration in its longitudinal direction, said building panel having in its transverse cross-section, a main concave body portion, a pair of side engagement portions at the respective opposite sides of said main body portion, each said side portion including flange means extending away from said main body portion on the concave side thereof, the flange means of one said side portion terminating in a female rib and the flange means of the other said side portion terminating in a male rib adapted for interlocking in a male rib adapted for interlocking engagement with a said female rib of a further said panel whereby adjacent said panels may be interlocked in use to define a generally arcuate roof structure, said female rib extending wholly to one side of its supporting flange means and away from said main body portion and said male rib extending from its supporting flange means in the same direction as said female rib whereby to permit adjacent said panels to be overlapped at the adjacent said side portions and be moved in the general direction of said side portions to enable said male rib of one said panel to engage and interlock with said female rib of the adjacent said panel; said female rib being of generally inverted U-shape form in transverse cross-section and having a first leg comprising an extension of said supporting flange means of said female rib and there being provided a first inwardly directed deformation in the region of the junction of said first leg and said supporting flange means; said male rib being of generally inverted U-shape form in transverse cross-section and having a first leg comprising an extension of said supporting flange means of said male rib, and there being provided an inwardly directed deformation defining a recess in the region of the junction of said first leg and said supporting flange means, said recess being complementary to said deformation, said first legs of said male and female ribs being juxtaposed and said first deformation being nested within said recess when adjacent said panels are interlocked wherein said female rib includes a second leg spaced from said first leg of said female rib and terminating at its free end in a further inwardly directed deformation substantially opposite the said first deformation to define therewith a restricted entrance into said female rib.

7. A building panel according to claim 6 wherein said male rib includes a second leg spaced from said first leg of said male rib and inclined outwardly therefrom, said second leg when adjacent panels are interlocked being resiliently engaged with said second leg of said female rib rearwardly of said further deformation.

8. A building having an arcuate self supporting roof structure comprising a plurality of interconnected panels, each said panel having in its longitudinal direction a generally arcuate configuration, each said panel having in its transverse cross-section, a main concave body portion, a pair of side engagement portions at the respective opposite sides of said main body portion, each said side portion including flange means extending away from said main body portion on the concave side thereof, the flange means of one said side portion terminating in a female rib and the flange means of the other said side portion terminating in a male rib, said male rib being interlocked with the female rib of an adjacent said panel to define said arcuate roof structure, said female rib extending wholly to one side of its supporting flange means and away from said main body portion and said male rib extending from its supporting flange means in the same direction as said female rib, said female rib being of generally inverted U-shaped form in transverse cross-section and having a first leg comprising an extension of said supporting flange means of said female rib and a second leg spaced from said first leg, said second leg having at its free end an inwardly directed first deformation and there being provided a second deformation in the region of the junction between said first leg and said supporting flange means arranged substantially opposite and extending inwardly towards said first deformation, said male rib being of generally inverted U-shape form in transverse cross-section and received within the female rib of an adjacent said panel, said male rib including a first leg comprising an extension of said supporting flange means of said male rib, and a second leg spaced from said first leg and inclined outwardly away from said first leg and there being provided a recess in the region of the junction between said first leg and said supporting flange means of said male rib, said recess being complementary to said second deformation and nestingly receiving said second deformation of said female rib of said adjacent panel, said first leg of said male rib being juxtaposed with said first leg of said adjacent panel female rib and said second leg thereof resiliently engaging said second leg of said adjacent panel female rib rearwardly of said first deformation thereof.

9. A building according to claim 8 wherein said flange means of said side portions of adjacent said panels are juxtaposed.

10. A building according to claim 8 wherein said flange means and said main body portions of said panels are transversely corrugated.

* * * * *